US006114076A

United States Patent [19]

Odell et al.

[11] Patent Number: 6,114,076

[45] Date of Patent: Sep. 5, 2000

[54] REACTIVE MELT MIXING PROCESSES

[75] Inventors: Peter G. Odell, Mississauga; Stephan V. Drappel, Toronto; Michael S. Hawkins, Cambridge, all of Canada

[73] Assignee: Xerox Corporation, Stamford, Conn.

[21] Appl. No.: 08/158,580

[22] Filed: Nov. 29, 1993

[51] Int. Cl.[7] ..... G03G 9/00

[52] U.S. Cl. ..... 430/109; 430/137; 430/904; 525/444; 525/437; 522/24; 522/165

[58] Field of Search ..... 430/109, 137, 430/904; 525/444, 437, 24, 165

[56] References Cited

U.S. PATENT DOCUMENTS

| | | | |
|---|---|---|---|
| 3,590,000 | 6/1971 | Palermiti et al. | 252/62.1 |
| 3,681,106 | 8/1972 | Burns et al. | 117/17.5 |
| 4,894,308 | 1/1990 | Mahabadi et al. | 430/137 |
| 5,053,463 | 10/1991 | Inoue | 525/427 |
| 5,057,392 | 10/1991 | McCabe et al. | 430/109 |
| 5,166,026 | 11/1992 | Fuller et al. | 430/109 |
| 5,194,472 | 3/1993 | Wilson et al. | 430/109 |
| 5,227,460 | 7/1993 | Mahabadi et al. | 528/272 |
| 5,352,556 | 10/1994 | Mahabadi et al. | 430/109 |

*Primary Examiner*—Laura Weiner
*Attorney, Agent, or Firm*—E. O. Palazzo

[57] ABSTRACT

A reactive melt mixing process for the preparation of a low fix temperature toner resin, comprising:

(a) mixing a reactive base resin, an initiator, and a polyester with amine functionality, and (b) crosslinking the resulting polymer melt under high shear to form a crosslinked toner resin.

20 Claims, 1 Drawing Sheet

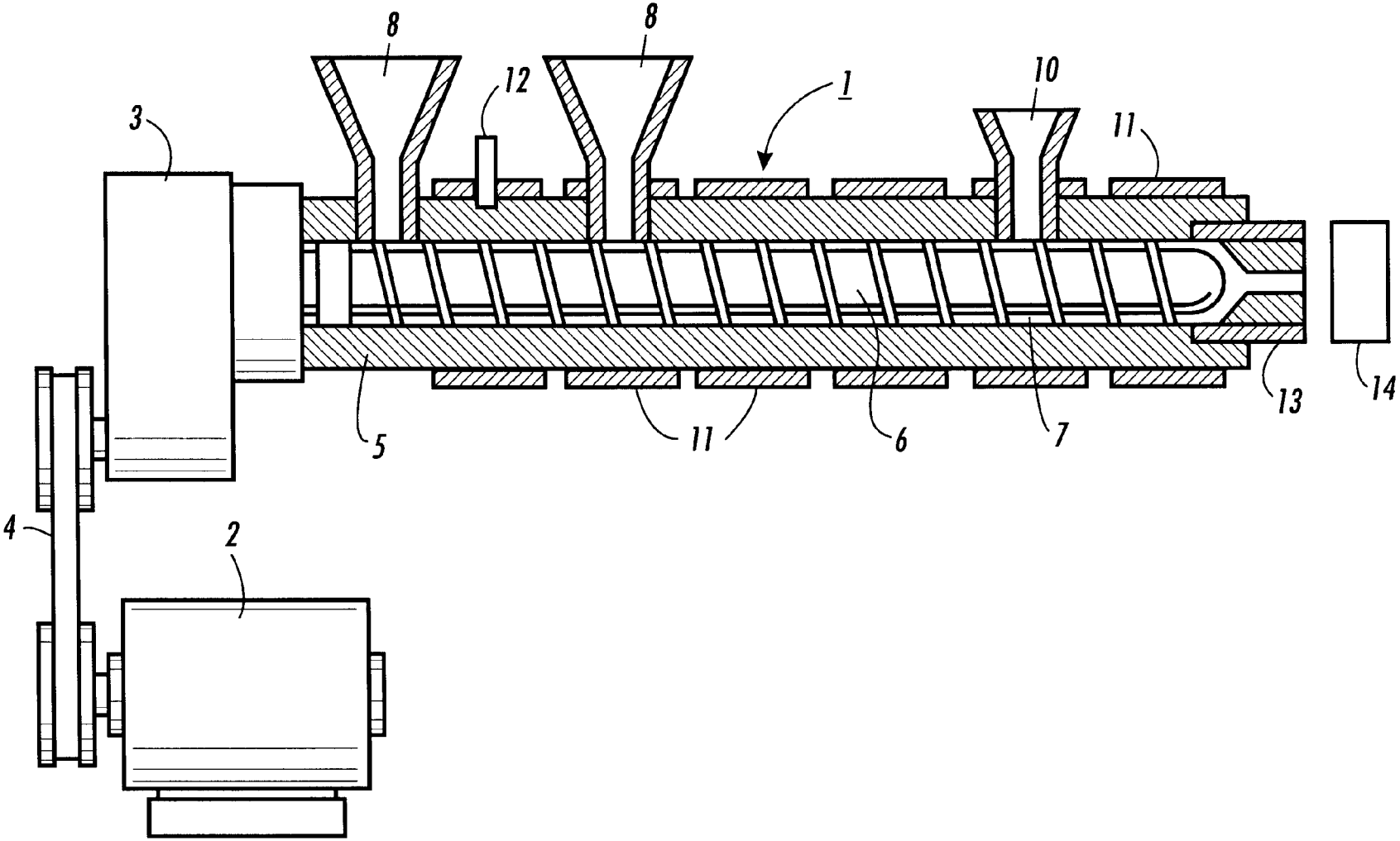
14
13
11
10
7
6
1
11
8
12
8
5
2
3
4

REACTIVE MELT MIXING PROCESSES

BACKGROUND OF THE INVENTION

The present invention is generally directed to processes for the preparation of toner resins and toner compositions. More specifically, the present invention in embodiments relates to melt mixing processes, batch or continuous, such as, for example, reactive extrusion for preparing crosslinked toner resins. The present invention in embodiments relates to processes for crosslinking reactive linear resins that can be selected for the preparation of crosslinked toner resins and which resins can be utilized as heat fixable toners with superior fusing and vinyl offset performance, and which processes induce or enable initiator decomposition by reaction with an amine functionalized polyester. The process of the present invention in embodiments enable process flexibility, safe reactions with high temperature initiators, such as t-butylhydroperoxide, and crosslinking of the resin becomes primarily a function of mixing during extrusion, and not a function of both temperature and mixing. In embodiments the present invention is directed to improved processes for the preparation of crosslinked toner resins, and toner compositions thereof, reference U.S. Ser. No. 814,641 (D/91117) and U.S. Pat. No. 5,227,460 (D/91117Q), the disclosures of which are totally incorporated herein by reference, by the reaction, preferably in an extruder, of an initiator with an amine polyester, and the subsequent reaction with a resin that contains at least one unsaturation site, or double bond, including polyesters like SPAR™, whereby crosslinking of the resin is accomplished. In embodiments, a resin, such as a polyester, like a SPAR™ polyester, an amine functionalized polyester, and an initiator are added to an extruder, followed by heating whereby the initiator reacts with the amine functionally to form free radicals, which subsequently react with the unsaturation sites of the resin to form a crosslinked resin. The aforementioned extrusion reaction can be accomplished in the presence of pigments like carbon black, and toner additives, such as charge additives to enable toner compositions.

Toner utilized in development in the electrographic process may be generally prepared by mixing and dispersing a colorant and a charge enhancing additive into a thermoplastic binder resin, followed by micropulverization. As the thermoplastic binder resin, several polymers are known, including polystyrenes, styrene-acrylic resins, styrene-methacrylic resins, polyesters, epoxy resins, acrylics, urethanes and copolymers thereof. Examples of colorants include carbon black and magnetites, and as charge enhancing additive examples there may be selected alkyl pyridinium halides, distearyl dimethyl ammonium methyl sulfates, and the like.

To fix the toner to a support medium, such as a sheet of paper or transparency, hot roll fixing is commonly used. In this method, the support medium with a toner image is transported between a heated fuser roll and a pressure roll with the image face contacting the fuser roll. Upon contact with the heated fuser roll, the toner melts and adheres to the support medium forming a fixed image. This fixing system is very advantageous in heat transfer efficiency and is especially suited for high speed electrophotographic processes.

Fixing performance of the toner can be characterized as a function of temperature. The lowest temperature at which the toner adheres to the support medium is referred to as the Cold Offset Temperature (COT), and the maximum temperature at which the toner does not adhere to the fuser roll is referred to as the Hot Offset Temperature (HOT). When the fuser temperature exceeds HOT, some of the molten toner adheres to the fuser roll during fixing and is transferred to subsequent substrates containing developed images resulting, for example, in blurred images. This undesirable phenomenon is known as offsetting. Between the COT and HOT of the toner is the Minimum Fix Temperature (MFT) which is the minimum temperature at which acceptable adhesion of the toner to the support medium occurs, as determined by, for example, a creasing test. The difference between MFT and HOT is referred to as the fusing latitude.

The hot roll fixing system and a number of toners used therein may, however, exhibit several problems, for example the binder resins in the toners can require a relatively high temperature in order to be affixed to the support medium. This may result in high power consumption, low fixing speeds, and reduced life of the fu; and fuser roll bearings. Also, offsetting can be a problem. Furthermore, toners containing vinyl type binder resins, such as styrene-acrylic resins, may have an additional problem which is known as vinyl offset. Vinyl offset occurs when a sheet of paper or transparency with a fixed toner image is contacted, for a period of time, with a polyvinyl chloride (PVC) surface containing a plasticizer used in making the vinyl material flexible such as, for example, in vinyl binder covers, and the fixed image adheres to the PVC surface.

There is a need for a toner resin with low fixing temperatures and high offset temperatures or wide fusing latitude, and superior vinyl offset properties, and process for the preparation of such a resin with excellent process latitudes; and wherein crosslinking of the resin is primarily a function of mixing during the reactive extrusion process.

To prepare lower fix temperature resins for toner, the molecular weight of the resin may be lowered. Low molecular weight amorphous polyester resins and epoxy resins have been selected to prepare low temperature fixing toners. For example, toners utilizing polyester resins as a binder are disclosed in U.S. Pat. Nos. 3,590,000 and 3,681,106. The minimum fixing temperature of polyester binder resins can be rendered lower than that of other materials, such as styrene-acrylic resins. However, this may result in the lowering of the hot offset temperature and, as a result, decreased offset resistance. In addition, the glass transition temperature of the resin may be decreased, which may cause the undesirable phenomenon of blocking of the toner during storage.

To prevent fuser roll offsetting and to increase fusing latitude of toners, modification of the binder resin structure by conventional polymerization processes, for example by branching, crosslinking, and the like has been attempted. For example, in U.S. Pat. No. 3,681,106 a process is disclosed whereby a polyester was improved with respect to offset resistance by nonlinearly modifying the polymer backbone by mixing a polyol, especially a trivalent polyol or polyacid with the monomer to generate branching during polycondensation. However, an increase in degree of branching may result in an elevation of the minimum fix temperature. Thus, any initial advantage of low temperature fix may be diminished.

Another method of improving offset resistance is by crosslinking during polymerization. In, for example, U.S. Pat. No. 3,941,898, a crosslinked vinyl type polymer prepared using conventional crosslinking was used as the binder resin. Similar disclosures for vinyl type resins are presented in U.S. Pat. Re. No. 31,072 (a reissue of No. 3,938,992); Nos. 4,556,624; 4,604,338 and No. 4,824,750. Also, crosslinked polyester binder resins using conventional polycondensation processes improving offset resistance are known, reference for example U.S. Pat. No. 3,681,106.

While improvements can be obtained in offset resistance and entanglement resistance, a major drawback may ensue with crosslinked resins prepared by conventional polymerization, both vinyl type processes including solution, bulk, suspension and emulsion polymerizations and polycondensation processes. In these processes, monomer and crosslinking agent are added to the reactor. The crosslinking reaction is not considered very rapid and chains can grow in more than two directions at the crosslinking point by the addition of monomers. Three types of polymer configurations may thus be produced, a linear and soluble portion referred to as the linear portion, a crosslinked portion which is low in crosslinking density and, therefore, is soluble in some solvents, such as tetrahydrofuran, toluene and the like, and is referred to as the sol; and a portion comprising highly crosslinked gel particles which is not soluble in substantially any solvent, such as tetrahydrofun, toluene and the like, and is referred to as the gel. The second portion with low crosslinking density (sol) is primarily responsible for widening the molecular weight distribution of the soluble part which results in an elevation of the minimum fixing temperature of the toner. Also, a drawback of these processes is that as more crosslinking agent is used the gel particles or very highly crosslinked insoluble polymer with high molecular weight increases in size. The large gels can be more difficult to disperse pigment in causing unpigmented toner particles during pulverization, and toner developability may thus be hindered. Also, with vinyl polymers the toners produced often evidence vinyl offset.

In U.S. Pat. No. 4,533,614, there is disclosed a process for preparing loosened crosslinked polyester binder resin which showed low temperature fix and good offset resistance, and wherein metal compounds were selected as crosslinking agents. Similar teachings are presented in U.S. Pat. No. 3,681,106, and Japanese Laid-open Patent Applications Nos. 94362/1981, 116041/1981 and 166651/1980. More specifically, there is disclosed in the No. '614 patent that the incorporation of metal complexes, however, can influence unfavorably the charging properties of the toner. Also, with color toners other than black, for example cyan toners, metal complexes can adversely the color of the pigments. It is also known that metal containing toner can have disposal problems in some areas, such as for example in the State of California, U.S.A. Metal complexes are often also expensive materials.

In U.S. Pat. No. 4,894,308, and U.S. Pat. No. 4,973,439 there are disclosed, for example, extrusion processes for preparing electrophotographic toner compositions in which pigment and charge control additive were dispersed into the binder resin in the extruder. However, in these patents, there is no suggestion of a chemical reaction occurring.

An injection molding process for producing crosslinked synthetic resin molded articles is disclosed in U.S. Pat. No. 3,876,736 in which polyolefin or polyvinyl chloride resin and crosslinking agent were mixed in an extruder, and then introduced into an externally heated reaction chamber outside the extruder wherein the crosslinking reaction occurred at increased temperature and pressure, and at low or zero shear.

In U.S. Pat. No. 4,089,917, an injection molding and crosslinking process is disclosed in which polyethylene resin and crosslinking agent were mixed in an extruder, and reacted in reaction chambers at elevated temperature and pressure. Heating of the resin mixture occurred partially by high shear in inlet flow orifices. However, the crosslinking reaction still took place in the reaction chambers at low or zero shear, and the final product is a thermoset molded part, and thus, is not useful for toner resins.

A process for dispensing premixed reactive precursor polymer mixtures through a die for the purposes of reaction injection molding or coating is described in U.S. Pat. No. 4,990,293 in which polyurethane precursor systems were crosslinked in the die and not in the extruder. The dimensions of the die channel were determined such that the value of the wall shear stress was greater than a critical value in order to prevent gel buildup and consequent plugging of the die. The final product is a thermoset molded part, and thus, is not useful for toner resins.

The processes disclosed in U.S. Pat. Nos. 3,876,736; 4,089,917 and 4,990,293 are not reactive extrusion processes because the crosslinking in each situation occurs in a die or a mold, and not in an extruder. These processes are for producing engineering plastics, such as thermoset materials which cannot, it is believed, be remelted once molded, and thus are not suitable for toner applications.

Illustrated in copending patent application U.S. Ser. No. 814,641 (D/91117) U.S. Pat. No. 5,227,460 (D/91117Q), the disclosures of which are totally incorporated herein by reference, is, for example, a reactive melt mixing process of preparing low fix temperature toner resin comprising the steps of (a) melting a reactive base resin, thereby forming a polymer melt; and (b) crosslinking said polymer melt under high shear to form a crosslinked toner resin and in embodiments further comprising the step of mixing a chemical initiator into the polymer melt at a temperature lower than the onset of crosslinking temperature, thereby producing a dispersion of the chemical initiator in the polymer melt prior to onset of crosslinking of the polymer melt. Disadvantages that may be associated with the aforementioned processes of the copending applications in embodiments thereof include decomposition of the initiator at high temperatures to form free radicals which in turn react prematurely, that is before complete mixing of initiator and polymer occurs, with the double bond of the polyester resin selected to form crosslinked sites, and heating and thorough mixing are needed. High levels of initiator may be necessary in the processes illustrated in the copending applications, and typically the initiators selected have a high explosion hazard relative to the preferred initiators selected for the processes of the present invention. These and other disadvantages are avoided or minimized with the processes of the present invention.

SUMMARY OF THE INVENTION

The present invention in embodiments provides a reactive melt mixing process to provide low cost and safe crosslinked thermoplastic binder resins for use as toners which possess a low fix temperature and a high offset temperature, and which evidence minimized or substantially no vinyl offset. In this process, polymers are crosslinked in the molten state under high shear conditions, producing substantially uniformly dispersed microgels of high crosslinking density, preferably using certain chemical initiators as crosslinking agents in an extruder, preferably without utilizing monomer for crosslinking, and with minimized or no residual materials remaining in the resin after crosslinking. More specifically, the process of the present invention comprises adding and reacting in an extruder a polyester with amine functionality, an initiator, and a toner resin with unsaturation, like a SPAR polyester, wherein the amine functionality reacts with the initiator to form free radicals and, subsequently, the free radicals formed in the extruder react with the unsaturation sites of the unsaturated resin to form a crosslinked resin. Toner compositions can be generated by, for example, adding to the extruder before the addition of pigment, charge additives, and other toner additives. Alternatively, the toner may be prepared by effectively blending the crosslinked resin obtained from the extruder with pigment, and charge additive.

The present invention provides an economical, robust and reproducible process for preparing resins for toner by batch or continuous processes. In this process, crosslinking is accomplished very rapidly to form microgel particles during melt mixing. High shear conditions disperse the microgels substantially uniformly in the polymer melt and prevent the microgels from continuing to increase in size with increasing degree of crosslinking.

Disclosed in copending application U.S. Ser. No. 118,845 (D/93099) is a functional-amine polyester polymer comprising at least a first residue of a first monomer, a second residue of a second monomer and from about 0.1 to about 10.0 mole percent of a functional-amine residue of a functional amine, said polyester polymer being prepared by reacting the first and second monomers and the functional amine in an inert atmosphere, the functional amine having a functional group to facilitate polymerizing the functional amine and the first and second monomers, the functional-amine residue facilitating reaction of the functional-amine polyester in an organic peroxide crosslinking reaction system.

Embodiments of the present invention include a reactive melt mixing process for the preparation of a low fixable temperature toner resin, comprising (a) mixing a reactive base resin, an initiator, and a polyester with amine functionality, and (b) crosslinking the resulting polymer melt under high shear to form a crosslinked toner resin; a process wherein the linear unsaturated base polyester resin selected has a number average molecular weight ($M_n$) as measured by gel permeation chromatography (GPC) in the range of from 1,000 to about 20,000, weight average molecular weight ($M_w$) in the range from 2,000 to about 40,000, a molecular weight distribution ($M_w/M_n$) in the range of from about 1.5 to about 6, an onset glass transition temperature (Tg) as measured by differential scanning calorimetry in the range of from about 50° C. to about 70° C., and a melt viscosity as measured with a mechanical spectrometer at 10 radians per second of from about 5,000 to about 200,000 poise at 100° C., which melt viscosity decreases with increasing temperature to from about 100 to about 5,000 poise at 130° C.; a process wherein the linear unsaturated polyester base resin selected is prepared from (a) unsaturated diacids or anhydrides selected from the group consisting of maleic acid, fumaric acid, chloromaleic acid, itaconic acid, citraconic acid, mesaconic acid, maleic anhydride, and mixtures thereof; (b) diols selected from the group consisting of propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and mixtures thereof; optionally (c) diacids or anhydrides selected from the group consisting of succinic acid, glutaric acid, adipic acid, pimelic acid, suberic acid, azelaic acid, sebacic acid, isophthalic acid, terephthalic acid, hexachloroendomethylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and mixtures thereof; and (d) unsaturated acids selected from the group consisting of methacrylic acid and acrylic acid; and a toner comprised of the toner resin obtained by the processes of the present invention and pigment; and a developer comprised of toner and carrier particles.

In the process of the present invention, in embodiments a reactive resin (base resin), such as, for example, an unsaturated linear polyester resin, is crosslinked in the molten state under high temperature and high shear conditions with free radicals generated by the reaction of an amine polyester with initiator in a batch or continuous melt mixing device without forming any significant amounts of residual materials. Thus, the removal of byproducts or residual unreacted materials is avoided with embodiments of the process of the present invention. In preferred embodiments of the process, the base resin and amine polyester are preblended and fed upstream to a melt mixing device, such as an extruder, or the base resin and amine polyester are fed separately to the melt mixing device, for example an extruder at either upstream or downstream locations and the initiator is subsequently added. An extruder screw configuration, length and temperature may be used which enable the initiator to be excellently dispersed in the polymer melt before the onset of crosslinking, and further, which provide a sufficient, but short, residence time for the crosslinking reaction to be accomplished. Extruder screw configuration and length can also provide high shear conditions to distribute microgels, formed during the crosslinking reaction, in the polymer melt, and to retain the microgels from inordinately increasing in size with an increasing degree of crosslinking. An optional devolatilization zone may be used to remove any volatiles, if needed. The polymer melt may then be pumped through a die to a pelletizer.

The process of the invention can be utilized to produce low cost, safe crosslinked toner resins and toners thereof with substantially no unreacted or residual byproducts of crosslinking, and which resins can be sufficiently fixed at low temperature by hot roll fixing to afford energy saving, are particularly suitable for high speed fixing, evidence excellent offset resistance and wide fusing latitude, for example low fix temperature and high offset temperature, and evidence minimal or no vinyl offset.

In embodiments, the present invention involves the following steps. Initially, the synthesis of the amine containing polyester is accomplished in, for example, a reactor comprised of a 1 liter stainless steel shell equipped with a helical coil stirrer and a double mechanical seal, and driven by a 0.5 hp motor with a 30:1 gear reduction. A torque meter was also part of the stirrer drive. The reactor was heated electrically. The pressure was monitored by both pressure transducer and pirani gauge. The temperature was monitored by platinum RTD's. The pressure and temperature were precisely controlled and profiled by a Fischer and Porter Chameleon controller. A glass still head was used to collect the byproduct distillate. To this reactor were added 307 grams (0.9 mole) of propoxylated 4,4'-isopropylidene bisphenol; 18.1 grams (0.1 mole) of N-phenyldiethanolamine; 116 grams (1.0 mole) of fumaric acid; 0.5 milliliter of a catalyst titanium butoxide; and 0.4 gram of hydroquinone.

The reactor was then sealed and the temperature increased to about 50° C. at which time stirring was initiated at slow rate, about 5 rpm, which was later increased to about 20 rpm when the temperature reached 100° C. The temperature was then increased to about 185° C. and retained for about 150 minutes, then the temperature was increased to about 215° C. and maintained there for about 280 minutes. During the heating, the reactor was slowly flushed with carbon dioxide gas. The reactor pressure was maintained at about atmospheric pressure for the first 300 minutes and then lowered over the course of an hour to below 5 mbar with the carbon dioxide flow gradually being shut off during this time. The low pressure was maintained until the polymerization was terminated, approximately 60 minutes later. On reaction termination, the pressure was returned to atmospheric using carbon dioxide. The molten polymer was removed by means of a bottom drain valve. The obtained polymer, such as copoly[(4,4'-isopropylidenebisphenyl bispropanol bisether, N-phenyldiethanolamine)/fumaric acid] (0.45:0.05:0.5 molar) had a Tg of 62° C. as determined on a DuPont Instruments DSC 10. The GPC molecular weight averages were determined on a Waters chromatography system using a 100 Å, two 500 Å and 104 Å Waters Ultrastyragel columns calibrated with narrow molecular weight polystyrene standards and found to be $M_n$=5,900 and $M_w$=15,400. The product and its structure were confirmed by NMR.

To disperse small amounts of initiator thoroughly in the resin, 0.6 gram of t-butyl hydroperoxide was, for example, added dropwise to 100 grams of copoly[4,4'-isopropylidenebisphenyl bispropanol bisether/fumaric acid] (SPAR II™). Further, dispersion of the peroxide into the polyester was achieved by dry mixing in a Waring blender. The peroxide/polyester mixture was then extruded at 120° C. and 90 rpm in a Custom Scientific Instruments Extruder. The product was reground in the Waring blender, and was confirmed by rheological measurement that the peroxide did not appear to react under these conditions. Alternatively, particularly on a larger scale reactions the initiator can be added to the extruder by direct injection.

The crosslinking reaction can be accomplished in a variety of formulations and equipment. For example, higher gloss, lower gel content colored toner can be prepared as follows.

The following materials were dry mixed in a Waring blender: 5.5 grams of peroxide/polyester blend obtained as illustrated herein; copoly[4,4'-isopropylidenebisphenyl bispropanol bisether/fumaric acid]; 3.5 grams of (SPAR II™); copoly[(4,4'-isopropylidenebisphenyl bispropanol bisether; 1.0 gram of N-phenyl-diethanolamine)/fumaric acid] (0.45:0.05:0.5 molar); and 0.4 gram of PV FAST BLUE™.

This mixture was added to a Custom Scientific Instruments Extruder operated at 150° C. and 90 rpm. Once the intense blue color extrudate appeared, the rotation of the extruder was stopped for one minute to allow the reaction to start, rotation was resumed and the extrudate was collected for the next 20 to 30 minutes. The stopped rotation allows the viscosity of the polymer melt to increase and can be a convenient method of obtaining "steady-state" extrusion conditions; with this step all the subsequent extrudate appeared to have uniform properties in embodiments. Without this step, about 12 minutes of continuous extrusion was required to achieve a similar steady state effect. The toner produced was evaluated with a Rheometrics RMS 800 Mechanical Spectrometer with a parallel plate configuration and a radius of 12.5 millimeters. The rheological characterization was based on small amplitude oscillatory measurements. The tests involved frequency/temperature sweeps with frequency scans of from 0.1 radian per second to 100 radians per second and a temperature range of from 80° C. to 180° C. in 20° C. increments. The period for thermal equilibration at each temperature was 15 minutes. Rheology offers insight into some of the critical flow properties of the toner. The rheology of this toner sample was compared to a resin containing 7 percent gel by weight and produced by the processes of the copending application and mentioned herein, U.S. Ser. No. 814,641 (D/91117) and U.S. Pat. No. 5,227,460 (D/91117Q).

Illustrated in Graph 1 that follows is G', the storage modulus of the system, which is a measure of the test samples to store energy (elasticity), as a function of temperature plotted at a constant frequency. The curves in Graph 1 are essentially identical indicating that the initiation system of the present invention provides the same or similar product as the copending application U.S. Ser. No. 814,641 (D/91117) and U.S. Pat. No. 5,227,460 (D/91117Q). At low temperature, both materials display similar viscoelastic properties, which provide a similar Minimum Fix Temperature (MFT); at higher temperatures the crosslinked toner samples display higher viscoelasticity, which results in a more cohesive fused image that remains on the paper and does offset onto the fuser roll, that is a higher hot offset temperature (HOT). The combined result is a broader fusing latitude.

GRAPH 1

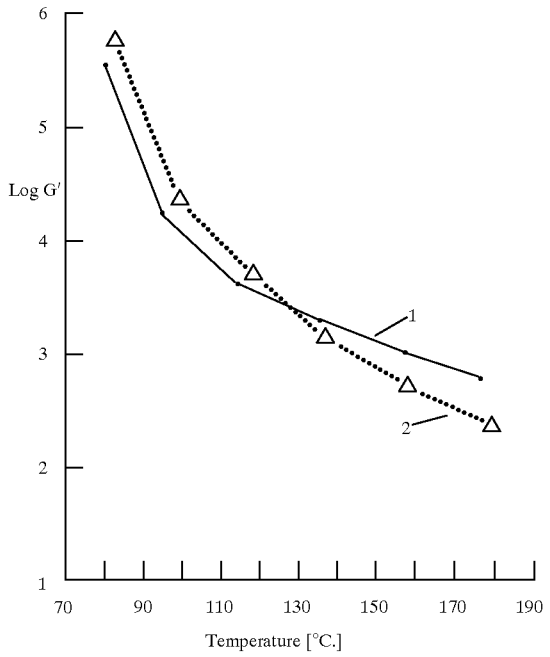

1 - Toner of present invention
2 - Toner, 7 percent gel resin

Alternatively, the aforementioned process can be selected with the following formulation: 25.0 grams of peroxide/polyester blend illustrated herein; 18.5 grams of copoly[4,4'-isopropylidenebisphenyl bispropanol bisether/fumaric acid] (SPAR II™); 2.5 grams of copoly[(4,4'-isopropylidenebisphenyl bispropanol bisether, N-phenyldiethanolamine)/fumaric acid] (0.45:0.05:0.5 molar); 3.0 grams of carbon black (REGAL 330®); and 1.0 gram of cetylpyridinium chloride charge additive.

The resulting toner was evaluated using a Rheometrics RMS 800 Mechanical Spectrometer with the parallel plate configuration and a radius of 12.5 millimeters. The rheological characterization was based on small amplitude oscillatory measurements. The tests were frequency/temperature sweeps with frequency scans from 0.1 radian/second to 100 radians/second and a temperature range of from 80° C. to 180° C. in 20° C. increments. The period for thermal equilibration at each temperature was 15 minutes. The rheology of this toner sample was compared to a resin containing about 30 percent gel by weight. Illustrated in Graph 2 that follows is G', the storage modulus of the system, which is a measure of the test samples to store energy (elasticity), as a function of temperature plotted at a constant frequency. At low temperature, both toners 1 and 2 display similar viscoelastic properties which provides a similar Minimum Fix Temperature (MFT); at higher temperatures the crosslinked samples display higher viscoelasticity which results in a more cohesive fused image that remains on the paper and does offset onto the fuser roll, that is a higher hot offset temperature (HOT). The combined result is a broader fusing latitude. The higher crosslink density also results in a lower gloss image, and this is desirable for black matte applications.

Comparison of a toner of this invention with 30 percent gel resin toner of U.S. Ser. No. 814,641 is shown in Graph 2 that follows.

GRAPH 2

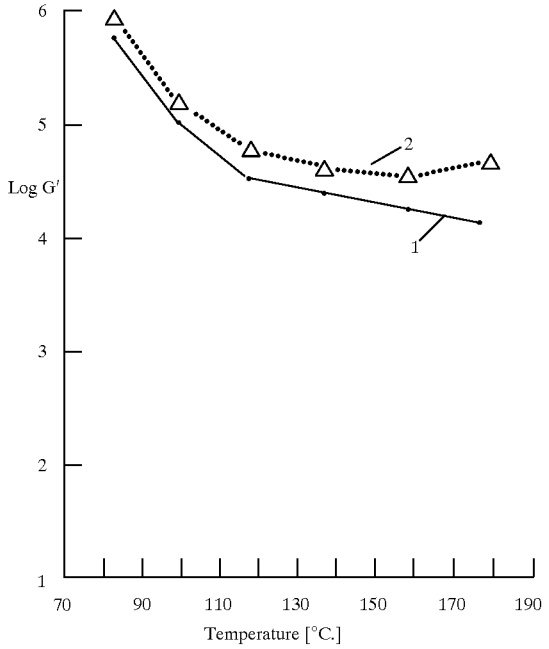

1 - Toner of present invention
2 - Toner, 30 percent gel resin

Different mixing devices may also be employed, for example the following materials were added to a Haake Melt Mixer to provide a cyan toner: 13.75 grams of the peroxide/polyester blend; 32.75 grams of copoly[4,4'-isopropylidenebisphenyl bispropanol bisether/fumaric acid] (SPAR II™); 2.5 grams of copoly[(4,4'-isopropylidenebisphenyl bispropanol bisether, N-phenyldiethanolamine)/fumaric acid] (0.45:0.05:0.5 molar); and 1.0 gram of PV FAST BLUE™. This mixture was melt mixed for 15 minutes at 150° C.

GRAPH 3

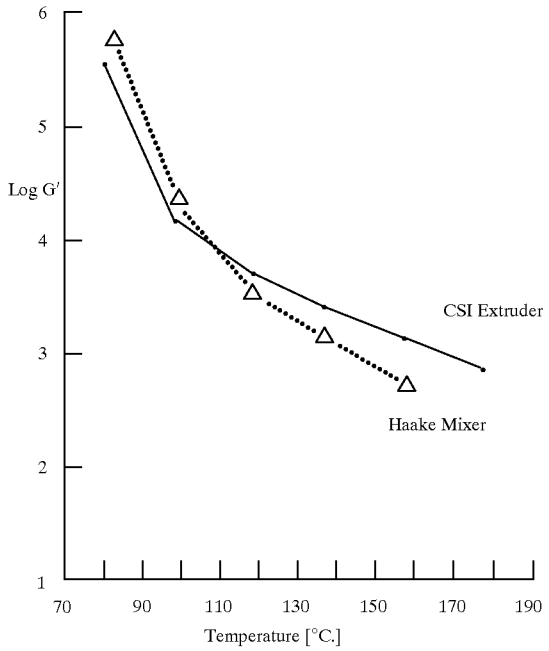

In Graph 3, the prepared cyan toner is compared with one prepared at a different scale in different equipment, as illustrated hereinbefore.

While not being desired to be limited by theory, it is believed that the initiation reaction mechanism may be similar to that proposed originally by Horner in *J. Polym. Sci.,* 18, 438, 1955, and enlarged upon by Feng and Sun in *Makromol. Chem.,* Macromol. Symp. 63, 1 to 18 (1992), the disclosures of which are totally incorporated herein by reference. It is summarized in the scheme below where $R_1$ and $R_2$ represent the polymer chains into which the amine moiety is incorporated. The t-butoxy free radical is believed to then react with a vinyl bond in the polymer backbone which subsequently forms a crosslink between polymer chains when it in turn reacts with another vinyl bond in the polymer backbone.

Mechanism:

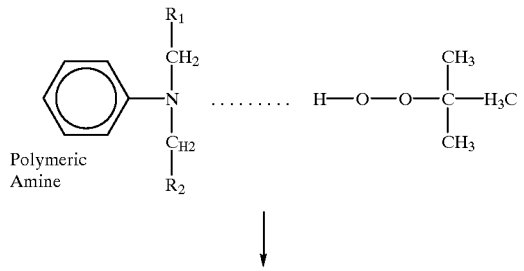

-continued

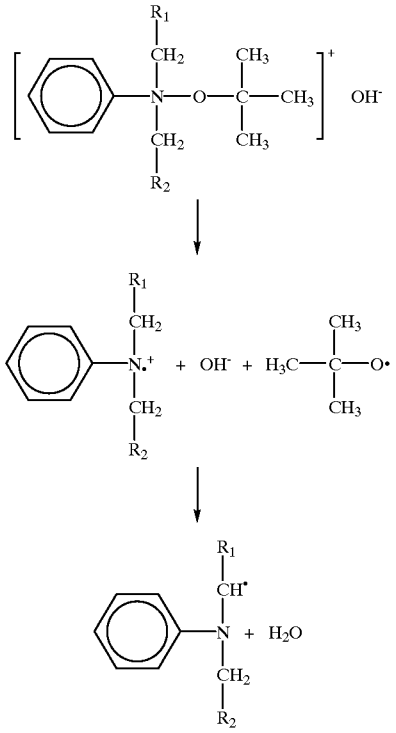

EMBODIMENTS

Low fix temperature toner resins and toner compositions thereof are fabricated by a reactive melt mixing process comprising the steps of: (1) melting a base resin, and an amine polyester, reference U.S. Ser. No. 119,939 (D/93267), the disclosure of which is totally incorporated herein by reference, thereby forming a polymer melt, in a melt mixing device; (2) adding initiator whereby the initiator reacts with the amine of the polyester to form free radicals; (3) retaining the polymer melt in the melt mixing device for a sufficient residence time to permit partial crosslinking of the base resin by attack of the free radicals on the unsaturated base resin; (4) providing sufficiently high shear during the crosslinking reaction, thereby retaining gel particles formed during crosslinking small in size and well distributed in the polymer melt; and (5) optionally devolatilizing the melt to remove any effluent volatiles.

In the process of the present invention, the fabrication of the crosslinked resin may be accomplished in a melt mixing device, such as an extruder as illustrated in U.S. Pat. No. 4,894,308, the disclosure of which is totally incorporated herein by reference, the copending patent application U.S. Ser. No. 814,641, and U.S. Pat. No. 5,227,460 (D/91117Q) mentioned herein. Generally, any high shear, high temperature melt mixing device suitable for processing polymer melts may be employed, provided that the objectives of the present invention are achieved. Examples of continuous melt mixing devices include single screw extruders or twin screw extruders, continuous internal mixers, gear extruders, disc extruders and roll mill extruders. Examples of batch internal melt mixing devices include Banbury mixers, Brabender mixers and Haake mixers.

One suitable type of extruder is the fully intermeshing corotating twin screw extruder such as, for example, the ZSK-30 twin screw extruder, available from Werner & Pfleiderer Corporation, Ramsey, N.J. U.S.A., which has a screw diameter of 30.7 millimeters and a length-to-diameter (L/D) ratio of 37.2. The extruder can melt the base resin, mix the initiator into the base resin melt, provide a suitable temperature and adequate residence time for the crosslinking reaction to be accomplished, control the reaction temperature by appropriate temperature control along the extruder channel, optionally devolatilize the melt to remove any effluent volatiles, and pump the crosslinked polymer melt through a die such as, for example, a strand die to a pelletizer. For chemical reactions in highly viscous materials, reactive extrusion is particularly efficient, and is advantageous since, for example, it requires no solvents, and thus is easily environmentally controlled. It is also advantageous since it permits a high degree of initial mixing of base resin and initiator to take place, and provides an environment wherein a controlled high temperature adjustable along the length of the extruder is available enabling rapid reaction to occur. Extrusion also enables the reaction to take place continuously, and thus the reaction is not limited by the disadvantages of a batch process, wherein the reaction must be repeatedly terminated to remove reaction products, and the apparatus cleaned and prepared for another similar reaction.

BRIEF DESCRIPTION OF THE DRAWING

FIG. 1 is a partially schematic cross-sectional view of an extrusion process suitable for the process of the present invention.

DETAILED DESCRIPTION OF THE DRAWINGS

For a better understanding of the present invention, a typical reactive extrusion apparatus suitable for the process of the present invention is illustrated in FIG. 1. FIG. 1 illustrates a twin screw extrusion device 1 containing a drive motor 2, a gear reducer 3, a drive belt 4, an extruder barrel 5, a screw 6, a screw channel 7, an upstream supply port or hopper 8, a downstream supply port 9, a downstream devolatilizer 10, a heater 11, a thermocouple 12, a die or head pressure generator 13, and a pelletizer 14. The barrel 5 consists of modular barrel sections, each separately heated with heater 11 and temperature controlled by thermocouple 12. With modular barrel sections, it is possible to locate feed ports and devolatilizing ports at required locations, and to provide segregated temperature control along the screw channel 7. The screw 6 is also modular enabling the screw to be configured with modular screw elements and kneading elements having the appropriate lengths, pitch angles, etc. in such a way as to provide optimum conveying, mixing, reaction, devolatilizing and pumping conditions.

In operation, the components to be reacted and extruded, the base resin, the amine polyester, or other unsaturated resin and chemical initiator enter the extrusion apparatus from the first upstream supply port 8 and/or second downstream supply port 9. The base resin, usually in the form of solid pellets, chips, granules, or other forms, the initiator, and the amine polyester can be fed to the first upstream supply port 8 and second downstream supply port 9 by starve feeding, gravity feeding, volumetric feeding, loss-in-weight feeding, or other known feeding methods. In one embodiment of the invention, especially if the initiator is a solid, the base resin and initiator are preblended prior to being added to the extruder, and the preblend, the base resin and/or additional initiator may be added through either upstream supply port 8, downstream supply port 9, or both. In another embodiment, especially if the-initiator is a liquid, the base resin and initiator can preferably be added to the extruder separately through upstream supply port 8, downstream supply port 9, or both. After the components have been fed into screw channel 7, heating is applied, which heating takes place from two sources: (1) external barrel heating from heaters 11, and (2) internal heating from viscous dissipation within the polymer melt itself. As the initiator becomes intimately mixed with the molten resin and comes in contact with the amine moiety in the polymer backbone, onset of the crosslinking reaction takes place. It is preferable, although not absolutely necessary, that the time required for completion of the crosslinking reaction not exceed the residence time in the screw channel 7. The rotational speed of the extruder screw preferably ranges from about 50 to about 500 revolutions per minute. If needed, volatiles may be removed through downstream devolatilizer 10 by applying a vacuum. At the end of screw channel 7, the crosslinked resin is pumped in molten form through die 13, such as for example a strand die, to pelletizer 14 such as, for example, a water bath pelletizer, underwater granulator, and the like.

With further reference to FIG. 1, the rotational speed of the screw 6 can be of any suitable value provided that the objectives of the present invention are achieved. Generally, the rotational speed of screw 6 is from about 50 revolutions per minute to about 500 revolutions per minute. The barrel temperature, which is controlled by thermocouples 12 and generated in part by heaters 11, is from about 40° C. to about 250° C. The temperature range for mixing the components in the upstream barrel zone is from about room temperature to the melting temperature of the base resin to below the crosslinking onset temperature, and preferably within about 40° C. of the melting temperature of the base resin. For example, for an unsaturated polyester base resin the temperature is preferably about 90° C. to about 130° C. The temperature range for the crosslinking reaction in the downstream barrel zones is above the crosslinking onset temperature and the base resin melting temperature, preferably within about 150° C. of the base resin melting temperature. For example, for an unsaturated polyester base resin, the temperature is preferably about 90° C. to about 250° C. The die or head pressure generator 13 generates pressure from about 50 pounds per square inch to about 500 pounds per square inch. In one embodiment, the screw is allowed to rotate at about 100 revolutions per minute, the temperature along barrel 5 is maintained at about 70° C. in the first barrel section and 160° C. further downstream, and the die pressure is about 50 pounds per square inch.

When crosslinking in a batch internal melt mixing device, the residence time is preferably in the range of about 10 seconds to about 5 minutes. The rotational speed of a rotor in the device is preferably about 10 to about 500 revolutions per minute.

The base resin selected for the process of the present invention in embodiments is a reactive polymer, preferably a linear reactive polymer such as, for example, a linear unsaturated polyester. In embodiments, the base resin has a degree of unsaturation of about 0.1 to about 30 mole percent, and preferably from about 5 to about 25 mole percent. In a preferred embodiment, the linear unsaturated polyester base resin is characterized by number average molecular weight ($M_n$) as measured by gel permeation chromatography (GPC) in the range typically of from about 1,000 to about 20,000, and preferably from about 2,000 to about 5,000, weight average molecular weight ($M_w$) in the range typically from about 2,000 to about 40,000, and preferably from about 4,000 to about 15,000. The molecular weight distribution ($M_w/M_n$) is in the range typically from about 1.5 to about 6, and preferably from about 2 to about 4. Onset glass transition temperature ($T_g$) as measured by differential scanning calorimetry (DSC) is in the range typically from 50° C. to about 70° C., and preferably from about 51° C. to about 60° C. Melt viscosity as measured with a mechanical spectrometer at 10 radians per second is from about 5,000 to about 200,000 poise, and preferably from about 20,000 to about 100,000 poise, at 100° C. and drops sharply with increasing temperature to from about 100 to about 5,000 poise, and preferably from about 400 to about 2,000 poise as temperature rises from 100° C. to 130° C.

Amine polyesters selected in various effective amounts, such as from about 1 to about 10, and wherein the amine contained in the polyester is present in small amounts as indicated herein, such as for example from about 1 to about 5 percent in embodiments, include low molecular weight condensation polymers which may be formed by the stepwise reactions between both saturated and unsaturated diacids (or anhydrides) and dihydric alcohols (glycols or diols) and diol amines sometimes known as alkanolamines. The resulting polymer may be a saturated or unsaturated polyester. Suitable diacids and anhydrides include but are not limited to saturated diacids and/or anhydrides such as, for example, succinic acid, glutaric acid, adipic acid, pimelic acid, suberic acid, azelaic acid, sebacic acid, isophthalic acid, terephthalic acid, hexachloroendomethylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like and mixtures thereof; and unsaturated diacids and/or anhydrides such as, for example, maleic acid, fumaric acid, chloromaleic acid, methacrylic acid, acrylic acid, itaconic acid, citraconic acid, mesaconic acid, maleic anhydride, and the like and mixtures thereof. Suitable diols include, but are not limited to, for example, propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like and mixtures thereof, soluble in solvents such as, for example, tetrahydrofuran, toluene and the like. Suitable diol amines include N-phenyidiethanolamine and 2,6-dimethanol pyridine, and in general aromatictertiary amine diols preferred as they, for example, provide charge stabilization during the promotion step.

Linear unsaturated polyesters selected as the base resin are low molecular weight condensation polymers which may be formed by the step-wise reactions between both saturated and unsaturated diacids (or anhydrides) and dihydric alcohols (glycols or diols). The resulting unsaturated polyesters are reactive, that is crosslinkable, in two respects: (i) unsaturation sites (double bonds) along the polyester chain, and (ii) functional groups such as carboxyl, hydroxy, and the like, which groups are considered amenable to acid-base reactions. Typical unsaturated polyesters are prepared by melt polycondensation or other polymerization processes with diacids and/or anhydrides and diols. Suitable diacids and anhydrides include, but are not limited to, saturated diacids and/or anhydrides such as, for example, succinic acid, glutaric acid, adipic acid, pimelic acid, suberic acid, azelaic acid, sebacic acid, isophthalic acid, terephthalic acid, hexachloroendomethylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like and mixtures thereof; and unsaturated diacids and/or anhydrides such as, for example, maleic acid, fumaric acid, chloromaleic acid, methacrylic acid, acrylic acid, itaconic acid, citraconic acid, mesaconic acid, maleic anhydride, and the like and mixtures thereof. Suitable diols include, for example, propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like and mixtures thereof, soluble in solvents such as, for example, tetrahydrofuran, toluene and the like.

Preferred linear unsaturated polyester base resins are prepared from diacids and/or anhydrides such as, for example maleic anhydride, fumaric acid, and the like and mixtures thereof, and diols such as, for example, propoxylated bisphenol A, propylene glycol, and the like and mixtures thereof. A particularly preferred polyester is poly (propoxylated bisphenol A fumarate) or SPAR resins and the like, reference copending patent application U.S. Ser. No. 814,641 (D/91117) and U.S. Pat. No. 5,227,460 (D/91117Q), the disclosures of which are totally incorporated herein by reference.

Suitable initiators in amounts of, for example, from about 1 to about 20 weight percent include hydroperoxides such as, for example, t-butyl hydroperoxide, 2,5-dihydroperoxy-2,5-dimethylhexane, cumene hydroperoxide, and t-amyl hydroperoxide, alkyl peroxides such as, for example, dicumyl peroxide, 2,5-dimethyl-2,5-di(t-butylperoxy) hexane, t-butyl-α-cumyl peroxide, α-α-bis(t-butylperoxy) diisopropyl benzene, di-t-butyl peroxide, t-amyl peroxide, and 2,5-dimethyl-2,5-di(t-butylperoxy)hexyne-3, peroxyesters such as, for example, t-amylperoxyacetate, t-butylperoxybenzoate, t-amylperoxybenzoate, t-butylperoxyacetate, OO-t-butyl-O-(2-ethylhexyl) monoperoxycarbonate, and OO-t-amyl-O-(2-ethyl hexyl) monoperoxycarbonate, OO-t-butyl-O-isopropylmonoperoxycarbonate, and alkyl peroxyketals such as, for example, 2,2-di(t-amylperoxy)propane, n-butyl-4,4-bis(t-butylperoxy)valerate, 1,1-di(t-butylperoxy)-3,3,5-trimethylcyclohexane, 1,1-di(t-butyl)peroxycyclohexane, 1,1-di(t-amylperoxy)cyclohexane, 2,2-di(t-butylperoxy) butane, ethyl 3,3-di(t-butylperoxy)butyrate ethyl 3,3-di(t-amylperoxy)butyrate and the like, reference copending patent application U.S. Ser. No. 814,641 (D/91117) and U.S. Pat. No. 5,227,460 (D/91117Q), the disclosures of which are totally incorporated herein by reference. Generally, peroxides that thermally decompose at higher temperatures are preferred so that the amine promoted decomposition is favored at the polymer melt processing temperatures.

In the crosslinking reaction, which occurs in the process of the present invention, the chemical initiator reacts with the amine of the polyester to form free radicals as indicated herein, which free radicals attack the linear unsaturated base resin polymer chains, that is at the double bonds, to form polymeric radicals. Crosslinking occurs as these polymeric radicals react with other unsaturated chains or other polymeric radicals many times forming very high molecular weight gel particles with high crosslinking density.

The crosslinking, which occurs in the process of the invention, is characterized by at least one reactive site with, for example, one unsaturation within a polymer chain reacting substantially directly with, for example, no intervening monomer(s) with at least one reactive site within a second polymer chain, and by this reaction occurring repeatedly to form a series of crosslinked units. This polymer crosslinking reaction may occur by a number of mechanisms.

The crosslinked resin produced is a clean and safe or nontoxic polymer mixture comprising crosslinked gel particles and a noncrosslinked or linear portion, but substantially no sol. The gel content of the crosslinked resin ranges from about 0.001 to about 50 percent by weight, and preferably from about 0.1 to about 40 or 10 to 19 percent by weight, wherein the gel content is as follows:

$$\text{Gel Content} = \frac{\text{Total Sample Weight} - \text{Weight of Soluble Polymer}}{\text{Total Sample Weight}} \times 100\%$$

There is substantially no crosslinked polymer which is not gel, that is low crosslink density polymer or sol, as would be obtained in conventional crosslinking processes such as, for example, polycondensation, bulk, solution, suspension, emulsion and suspension polymerization processes.

The crosslinked portions of the crosslinked resin are comprised of very high molecular weight microgel particles with high density crosslinking (as measured by gel content) and which are not soluble in substantially any solvents such as, for example, tetrahydrofuran, toluene and the like. The microgel particles are highly crosslinked polymers with a short crosslink distance of zero or a maximum of one atom such as, for example, oxygen.

The linear portions of the crosslinked resin have substantially the same number average molecular weight ($M_n$), weight average molecular weight ($M_w$), molecular weight distribution ($M_w/M_n$), onset glass transition temperature ($T_g$) and melt viscosity as the base resin. Thus, embodiments of the entire crosslinked resin have an onset glass transition temperature of from about 50° C. to about 70° C., and preferably from about 51° C. to about 60° C., and a melt viscosity of from about 5,000 to about 200,000 poise, and preferably from about 20,000 to about 100,000 poise, at 100° C. and from about 10 to about 20,000 poise at 160° C.

In preferred embodiments, the crosslinked polyester toner resin prepared enables the preparation of toners with minimum fix temperatures in the range of about 100° C. to about 200° C., preferably about 100° C. to about 160° C., and more preferably about 110° C. to about 140° C. Also, these low fix temperature toners have fusing latitudes ranging from about 10° C. to about 120° C., preferably more than about 20° C., and more preferably greater than about 30° C. The process of the invention can generate toner resins and, thus, toners with minimized or substantially no vinyl offset.

The crosslinked polymers obtained have the important rheological property of allowing a toner prepared therefrom to evidence a low fix temperature of about 110° C. to about 140° C. and a high offset temperature of about 160° C. to about 200° C. The low fix temperature is a function of the molecular weight and molecular weight distribution of the linear portion, and is believed not to be significantly affected by the amount of microgel or degree of crosslinking in the resin. This is portrayed by the proximity of the viscosity curves at low temperature such as, for example, at 100° C. as shown in Graph 2 for crosslinked unsaturated polyester. The hot offset temperature is increased with the presence of microgel particles which impart elasticity to the resin. With higher degree of crosslinking or gel content, the hot offset temperature increases. This is reflected in divergence of the viscosity curves at high temperature such as, for example, at 160° C. as also shown in Graph 2. As the degree of crosslinking or gel content increases, the low temperature melt viscosity does not change significantly while the high temperature melt viscosity goes up. In an exemplary embodiment, the hot offset temperature can increase approximately 30 percent. This can be achieved by crosslinking in the melt state at high temperature and high shear such as, for example, in an extruder resulting in the formation of microgel alone, distributed substantially uniformly throughout the linear portion, and no intermediates which are crosslinked polymers with low crosslinking density (sol). When crosslinked intermediate polymers are generated by conventional polymerization processes, the viscosity curves shift in parallel from low to high degree of crosslinking as shown in Graph 3. This is reflected in increased hot offset temperature, and also increased minimum fix temperature.

In addition to rendering unique Theological properties to the toner resin, the reactive melt mixing process has several other important advantages with the resins of the present invention. By selecting the type and molecular weight properties of the base resin, the minimum fix temperature can be manipulated. The hot offset temperature can be manipulated by the gel content in the crosslinked resin which can be controlled by the amount of initiator fed to the extruder and/or regulating the extruder process conditions such as, for example, feed rate, screw rotational speed, barrel temperature profile, and screw configuration and length. Thus, it is possible to produce a series of resins and toners thereof with the same MFT, but with different fusing latitudes.

The resins formed are generally present in the toner in an amount of from about 40 to about 98 percent by weight, and more preferably from about 70 to about 98 percent by weight, although they may be present in greater or lesser amounts. For example, toner resins obtained by the process of the present invention can be subsequently melt blended or otherwise mixed with a colorant, charge carrier additives, surfactants, emulsifiers, pigment dispersants, flow additives, and the like. The resultant product can then be pulverized by known methods, such as milling, to form toner particles. The toner particles preferably have an average volume particle diameter of about 5 to about 25, and more preferably about 10 to about 20 microns. Also, alternatively the pigment and charge additive can be added to the extruder to form a toner composition.

Various suitable colorants can be employed in toners of the invention, including suitable colored pigments, dyes, and mixtures thereof including carbon black, such as REGAL 330® carbon black (Cabot), Acetylene Black, Lamp Black, Aniline Black, Chrome Yellow, Zinc Yellow, Sicofast Yellow, Luna Yellow, NOVAPERM YELLOW™, Chrome Orange, Bayplast Orange, Cadmium Red, LITHOL SCARLET™, HOSTAPERM RED™, FANAL PINK™, HOSTAPERM PINK™, LITHOL RED™, RHODAMINE LAKE B™, Brilliant Carmine, HELIOGEN BLUE™, HOSTAPERM BLUE™, NEOPAN BLUE™, PV FAST BLUE™, Cinquassi Green, HOSTAPERM GREEN™, titanium dioxide, cobalt, nickel, iron powder, SICOPUR 4068 FF™, and iron oxides such as MAPICO BLACK® (Columbia), NP608™ and NP604™ (Northern Pigment), BAYFERROX 8610™ (Bayer), MO8699™ (Mobay), TMB-100™ (Magnox), mixtures thereof, and the like.

The colorant, preferably carbon black, cyan, magenta and/or yellow colorant, is incorporated in an amount sufficient to impart the desired color to the toner. In general, pigment or dye is employed in an amount ranging from about 2 to about 60 percent by weight, and preferably from about 2 to about 7 percent by weight for color toner and about 5 to about 60 percent by weight for black toner.

Various known suitable effective positive or negative charge enhancing additives can be selected for incorporation into the toner compositions produced by the present invention, preferably in an amount of about 0.1 to about 10, more preferably about 1 to about 3, percent by weight. Examples include quaternary ammonium compounds inclusive of alkyl pyridinium halides; alkyl pyridinium compounds, reference U.S. Pat. No. 4,298,672, the disclosure of which is totally incorporated herein by reference; organic sulfate and sulfonate compositions, U.S. Pat. No. 4,338,390, the disclosure of which is totally incorporated hereby by reference; cetyl pyridinium tetrafluoroborates; distearyl dimethyl ammonium methyl sulfate; aluminum salts such as BONTRON E84™ or E88™ (Hodogaya Chemical); and the like.

Additionally, other internal and/or external additives may be added in known amounts for their known functions. For example, surface additives of colloidal silicas, such as AEROSILS®, metal oxides like tin oxide, titanium oxide, and the like, and metal salts of fatty aids, such as zinc stearate, can be added to the toner in effective amounts of, for example, 0.1 to about 5, and preferably about 3 percent by weight.

The resulting toner particles optionally can be formulated into a developer composition by mixing with carrier particles. Illustrative examples of carrier particles that can be selected for mixing with the toner composition prepared in accordance with the present invention include those particles that are capable of triboelectrically obtaining a charge of opposite polarity to that of the toner particles. Accordingly, in one embodiment the carrier particles may be selected so as to be of a negative polarity in order that the toner particles which are positively charged will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the disclosure of which is totally incorporated herein by reference, comprised of nodular carrier beads of nickel, characterized by surfaces of reoccurring recesses and protrusions thereby providing particles with a relatively large external area. Other useful carriers are disclosed in U.S. Pat. Nos. 4,937,166 and 4,935,326, the disclosures of which are totally incorporated herein by reference.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluoroethylenes, other known coatings and the like.

The diameter of the carrier particles is generally from about 50 microns to about 1,000 microns, preferably about 50 to about 200 microns, thus allowing these particles to, for example, possess sufficient density and inertia to avoid adherence to the electrostatic images during the development process. The carrier particles can be mixed with the toner particles in various suitable combinations. Best results are obtained when about 1 part carrier to about 10 parts to about 200 parts by weight of toner are mixed.

Toners formulated by the process of the present invention can be used in known electrostatographic imaging methods, although the fusing energy requirements of some of those methods can be reduced in view of the advantageous fusing properties of the subject toners as discussed herein. Thus, for example, the toners or developers can be charged, for example, triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll at a temperature lower than 200° C., preferably lower than 160° C., more preferably lower than 140° C., and more preferably about 110° C.

Substantially any suitable unsaturated polyester can be used in the process of the invention, including unsaturated polyesters known for use in toner resins and including unsaturated polyesters whose properties may have rendered them undesirable or unsuitable for use as toner resins.

The invention will further be illustrated in the following nonlimiting Examples, it being understood that these Examples are intended to be illustrative only and that the invention is not intended to be limited to the materials, conditions, process parameters and the like recited herein. Parts and percentages are by weight unless otherwise indicated.

EXAMPLE I

Polyesteramine Synthesis:

The reactor employed was a 1 liter stainless steel reactor equipped with a helical coil stirrer and a double mechanical seal. It was driven by a 0.5 horsepower motor with a 30:1 gear reduction. A torque meter was also part of the stirrer drive. The reactor was heated electrically. The pressure was monitored by both a pressure transducer and a pirani gauge. The temperature was monitored by platinum RTD (Resistance Temperature Device, a temperature sensor). The pressure and temperature were precisely controlled and profiled by a Fischer and Porter Chameleon controller. A glass still head was used to collect the byproduct distillate. To this reactor were added 307 grams (0.9 moles) of propoxylated 4,4'-isopropylidenebisphenol; 18.1 grams (0.1 mole) of N-phenyidiethanolamine; 116 grams (1.0 mole) of fumaric acid; 0.5 milliliter of titanium butoxide; and 0.4 gram of hydroquinone.

The reactor was sealed and the temperature raised to about 50° C. at which time stirring was begun at slow, less than 2 rpm rate, which was later increased to about 20 rpm when the temperature reached 100° C. The temperature was raised to about 185° C. and held there for about 150 minutes, then the temperature was raised to about 215° C. and maintained there for about 280 minutes. During the heating, the reactor was slowly flushed with carbon dioxide gas. The reactor pressure was maintained at about atmospheric pressure for the first 300 minutes and then lowered over the course of one hour to below 5 mbar with the carbon dioxide flow gradually being shut off during this time. The low pressure was maintained until the polymerization was terminated, approximately 60 minutes later. At the reaction end, the pressure was returned to atmospheric pressure using carbon dioxide. The molten polymer was removed by means of a bottom drain valve. The obtained polymer, copoly[(4,4'-isopropylidenebisphenyl bispropanol bisether, N-phenyldiethanolamine)/fumaric acid] (0.45:0.05:0.5 molar) had a Tg of 62° C. as determined on a DuPont Instruments DSC 10. The GPC molecular weight averages for the polymer product were determined on a Waters chromatography system using a 100 Å, two 500 Å and a 104 Å Waters Ultrastyragel columns calibrated with narrow molecular weight polystyrene standards and found to be $M_n$=5,900 and $M_w$=15,400. NMR confirmed the structure as follows

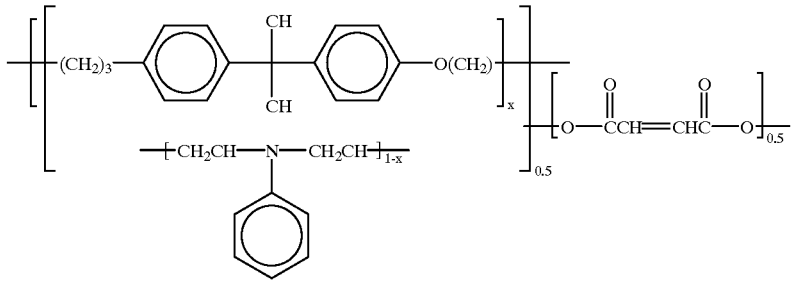

x = 0.99–0.5

EXAMPLE II 0.6 Gram of t-butyl hydroperoxide was dispersed in 100 grams of copoly[4,4'-isopropylidenebisphenyl bispropanol bisether/fumaric acid] (SPAR II™) added dropwise. Further, dispersion of the peroxide into the polyester was achieved by dry mixing in a Waring blender. The peroxide/polyester mixture was then extruded at 120° C. and 90 rpm in a Custom Scientific Instruments Extruder. This product was reground in the Waring blender. It was confirmed that the peroxide did not react under these conditions.

EXAMPLE III (24414-96A):

The following materials were dry mixed in a Waring blender: 15.6 grams of peroxide/polyester blend from Example II; 4.0 grams of copoly[(4,4'-isopropylidenebisphenyl bispropanol bisether, N-phenyldiethanolamine)/fumaric acid] (0.45:0.05:0.5 molar) (from Example I); and 0.4 gram of PV FAST BLUE™.

This mixture was added to a Custom Scientific Instruments Extruder operated at 150° C. and 90 rpm. Once the intense blue color extrudate appeared, the rotation of the extruder was stopped for one minute to allow the reaction to start, rotation was resumed, and extrudate was collected for the next 20 to 30 minutes. This extrudate was comprised of a cyan toner with the composition above except that the gel forming crosslinking has occurred, and it is estimated that the gel content is about 30 percent based on the rheology as illustrated in Example XIII.

EXAMPLE IV (24414-96B):

The procedures of Example III were repeated with the following formulation: 7.0 grams of the peroxide/polyester blend of Example II; and copoly[4,4'-isopropylidenebisphenyl bispropanol bisether/fumaric acid], which is a unsaturated polyester with the following structure

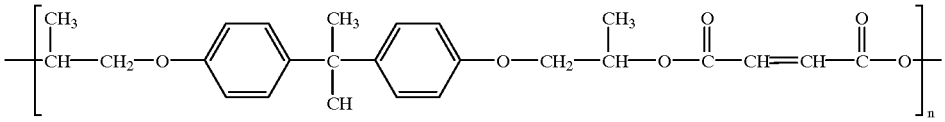

wherein n is the number of repeating units and having $M_n$ of about 4,000, $M_w$ of about 10,300, $M_w/M_n$ of about 2.58 as measured by GPC, onset Tg of about 55° C. as measured by DSC, and melt viscosity of about 29,000 poise at 100° C. and about 750 poise at 130° C. as measured at 10 radians per second; 4.0 grams of copoly[(4,4'-isopropylidenebisphenyl bispropanol bisether, N-phenyl-diethanolamine)/fumaric acid] (0.45:0.05:0.5 molar) (from Example I); and 0.4 gram of PV FAST BLUE™.

The cyan toner product was of the composition above and it is estimated that the gel content was about 20 to 30 percent based on the rheology as illustrated in Example XIII.

EXAMPLE V (24414-96C):

The procedures of Example III were repeated with the following formulation: 4.0 grams of peroxide/polyester blend from Example II; 11.6 grams of copoly[4,4'-isopropylidenebisphenyl bispropanol bisether/fumaric acid]; 4.0 grams of copoly[(4,4'-isopropylidenebisphenyl bispropanol bisether, N-phenyl-diethanolamine)/fumaric acid] (0.45:0.05:0.5 molar) (from Example I); and 0.4 gram of PV FAST BLUE™. It is estimated that the gel content was about 2 to 5 percent based on the rheology as illustrated in Example XIII.

EXAMPLE VI (24414-97A):

The procedures of Example III were repeated with the following formulation: 7.0 grams of peroxide/polyester blend from Example II; 10.6 grams of copoly[4,4'-isopropylidenebisphenyl bispropanol bisetherifumaric acid]; 2.0 grams of copoly[(4,4'-isopropylidenebisphenyl bispropanol bisether, N-phenyl-diethanolamine)/fumaric acid] (0.45:0.05:0.5 molar) (from Example I); and 0.4 gram of PV FAST BLUE™. It is estimated that the gel content is about 20 to 30 percent based on the rheology as illustrated in Example XIV.

EXAMPLE VII (24414-97B):

The procedures of Example III were repeated with the following formulation: 7.0 grams of peroxide/polyester blend from Example II; 11.6 grams of copoly[4,4'-isopropylidenebisphenyl bispropanol bisether/fumaric acid] 1.0 gram of copoly[(4,4'-isopropylidenebisphenyl bispropanol bisether, N-phenyl-diethanolamine)/fumaric acid] (0.45:0.05:0.5 molar) (from Example I); and 0.4 gram of PV FAST BLUE™. It is estimated that the gel content was about 20 to 30 percent based on the rheology in Example XIV.

EXAMPLE VIII (24414-97D):

The procedures of Example III were repeated with the following formulation: 5.5 grams of peroxide/polyester blend from Example II; 13.5 grams of copoly[4,4'-isopropylidenebisphenyl bispropanol bisether/fumaric acid]; 1.0 gram of copoly[(4,4'-isopropylidenebisphenyl bispropanol bisether, N-phenyl-diethanolamine)/fumaric acid] (0.45:0.05:0.5 molar) (from Example I); and 0.4 gram of PV FAST BLUE™. It is estimated that the gel content was about 6 to 10 percent based on the rheology in Example XVI.

EXAMPLE IX (24414-97C)

The procedures of Example III were repeated with the following formulation: 4.0 grams of peroxide/polyester blend from Example II; 11.6 grams of copoly[4,4'-isopropylidenebisphenyl bispropanol bisether/fumaric acid]; 4.0 grams of copoly[(4,4'-isopropylidenebisphenyl bispropanol bisether, N-phenyl-diethanolamine)/fumaric acid] (0.45:0.05:0.5 molar) (from Example I); and 0.4 gram of PV FAST BLUE™. It is estimated that the gel content was about 2 to 5 percent based on the rheology of Example XV.

EXAMPLE X (24414-100A):

The procedures of Example III were repeated, except that the rotation of the extruder was stopped when an intense black rather than blue color was extruded, with the following formulation: 10.0 grams of peroxide/polyester blend from Example II; 4.4 grams of copoly[4,4'-isopropylidenebisphenyl bispropanol bisether/fumaric acid]; 4.0 grams of copoly[(4,4'-isopropylidenebisphenyl bispropanol bisether, N-phenyl-diethanolamine)/fumaric acid] (0.45:0.05:0.5 molar) (from Example I); 1.2 grams of carbon black (REGAL 330®); and 0.4 gram of cetylpyridinium chloride.

The product was a black toner with the composition above and with a gel content of about 30 percent.

EXAMPLE XI (24414-101B):

The following materials were added to a Haake Melt Mixer: 25 grams of peroxide/polyester blend from Example II; 18.5 grams of copoly[4,4'-isopropylidenebisphenyl bispropanol bisether/fumaric acid]; 2.5 grams of copoly[(4,4'-isopropylidenebisphenyl bispropanol bisether, N-phenyl-diethanolamine)/fumaric acid] (0.45:0.05:0.5 molar) (from Example I); 3.0 grams of carbon black (REGAL 330®); and 1.0 gram of cetylpyridinium chloride.

This mixture was melt mixed for 15 minutes at 150° C. The product was a black toner with the composition above and a gel content of about 30 percent.

EXAMPLE XII (24414-98):

The procedures of Example XI were repeated with the following formulation: 13.75 grams of peroxide/polyester blend from Example II; 32.75 grams of copoly[4,4'-isopropylidenebisphenyl bispropanol bisether/fumaric acid]; 2.5 grams of copoly[(4,4'-isopropylidenebisphenyl bispropanol bisether, N-phenyl-diethanolamine)/fumaric acid] (0.45:0.05:0.5 molar) (from Example I); and 1.0 grams of PV FAST BLUE™.

The product was a black toner with the composition above with gel forming crosslinking. It is estimated that the gel content was about 6 to 10 percent based on the rheology in Example XVI.

EXAMPLE XIII

Control of the viscoelastic properties of resin by varying initiator amounts of Examples III, IV and V were studied using a Rheometrics RMS 800 Mechanical Spectrometer with the parallel plate configuration and a radius of 12.5 millimeters. The rheological characterization was based on small amplitude oscillatory measurements. The tests were frequency/temperature sweeps with frequency scans from 0.1 radian/second to 100 radians/second and a temperature range from 80° C. to 180° C. in 20° C. increments. The period for thermal equilibration at each temperature was 15 minutes. The results are illustrated by the graph that follows. For comparison, an unreacted polyester (copoly[4,4'-isopropylidenebisphenyl bispropanol bisether/fumaric acid]) is also plotted in the graph. Rheology offers insight into some of the critical flow properties of a toner. Illustrated hereinafter is log G', the storage modulus, which is a measure of the test sample's ability to store energy (elasticity), as a function of temperature, plotted at a constant frequency. In general terms, the curves illustrate the increase in fusing latitude with crosslink density. At low temperature, the materials display similar viscoelastic properties which provide a similar Minimum Fix Temperature (MFT); at higher temperatures, the crosslinked samples display higher viscoelasticity which results in a more cohesive fused image that remains on the paper and does offset onto the fuser roll; that is a higher hot offset temperature (HOT). The combined result is a broader fusing latitude. The higher crosslink density also results in a lower gloss image; this is desirable for black matte applications, however, a higher gloss is required for color images and it is important to be able to provide intermediate viscoelastic properties as in Example V that will provide a higher gloss level than Examples III and IV, and broader fusing latitude than the unreacted SPAR control.

EXAMPLE XIII: Control of Viscoelastic Properties with Initiator Level

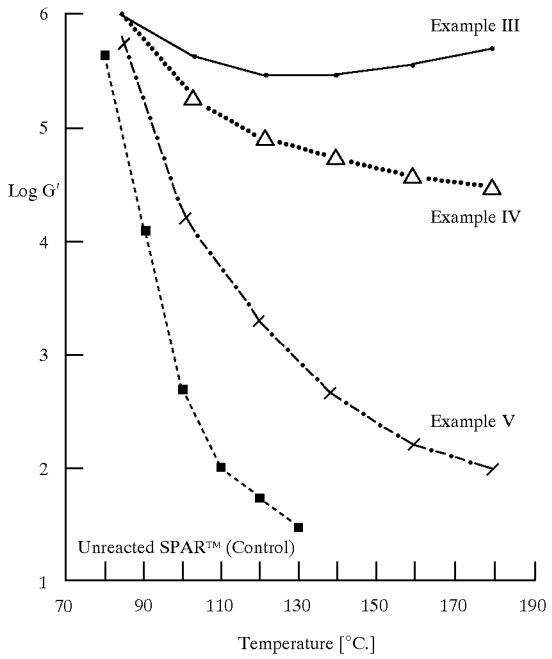

EXAMPLE XIV

The control of viscoelastic properties of resin can be accomplished by varying the amine loading. The Theological data was obtained with the method of Example XIII. There is little difference in the rheological behavior of the samples despite a two and threefold change in amine level. Thus, a change in amine concentration does not significantly shift the Log G' vs Temperature curve, and the greater difference shown by Example IV is likely due to a slight difference in peroxide content.

EXAMPLE XIV: Effect of Varying Amine Loading

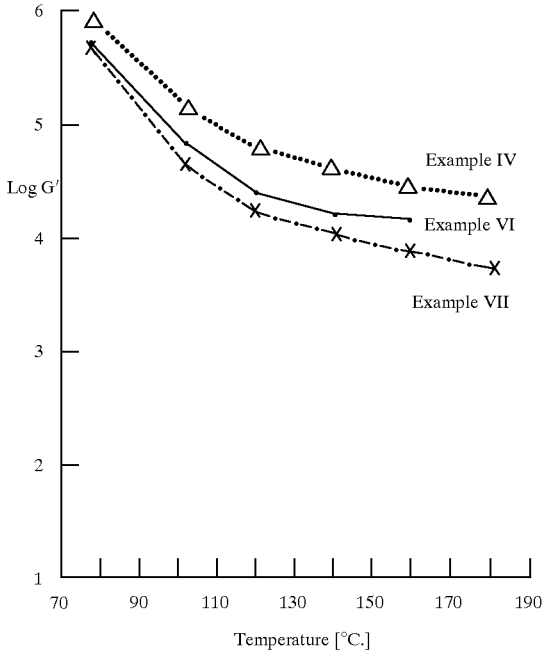

EXAMPLE XV

The rheological data was obtained with the method of Example XIII. This data displays the initiation system's independence from temperature as the reaction was diffusion driven rather than thermolytic. Slight effects due to temperature on diffusion and a bimolecular reaction are expected, but appear to be small, and do not significantly affect the product.

EXAMPLE XV: Independence from Temperature

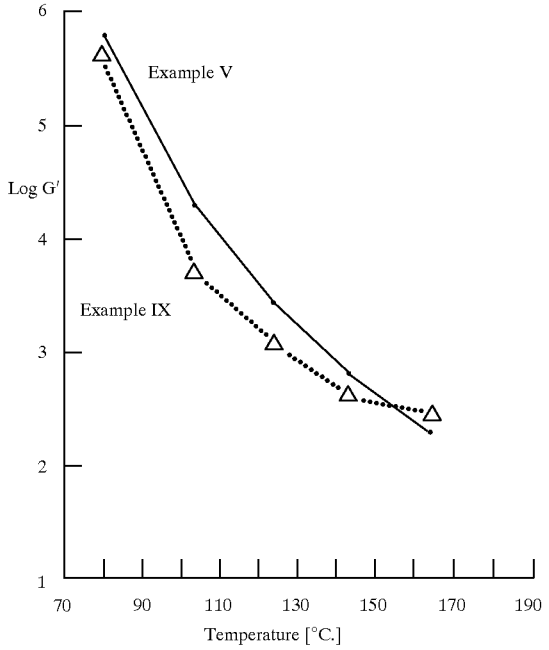

EXAMPLE XVI

The rheological data detailed in the graph that follows was obtained with the method of Example XIII and illustrates an independence from mixing configuration since nearly identical materials are achieved in different mixers; the CSI extruder and the Haake melt mixer. The data supports the mechanism that initiation results from excellent molecular mixing.

EXAMPLE XVI: Scaling—CSI Extruder and the Haake Melt Mixer

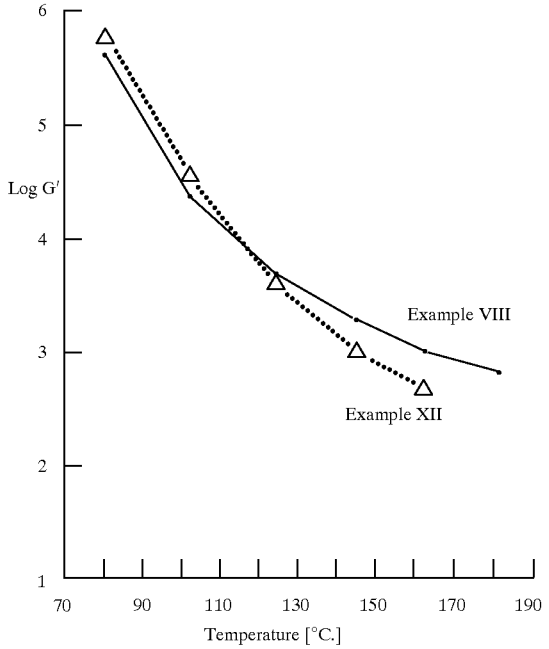

In embodiments, the process of the present invention is directed to a single step reactive extrusion utilizing a polyester with small, effective amounts, for example up to 5 weight percent, of a tertiary amine function to promote the homolysis of a high temperature free radical initiator at temperatures well below its one hour thermal half life, and which reaction can be accomplished together with pigments and charged additives; and which processes have a number of advantages as illustrated herein, including extending the fusing latitude of polyesters like SPAR II™, and mixing alone, rather than heating, and mixing with, for example, benzoyl peroxide initiator.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A reactive melt mixing process for the preparation of a low fix temperature toner resin, comprising:

(a) mixing a reactive base resin, an initiator, and a polyester with amine functionality, wherein said base resin is an unsaturated resin, and (b) crosslinking the resulting polymer melt under high shear to form a crosslinked toner resin, and wherein there occurs a reaction between said initiator and said amine functionality thereby forming free radicals which attack the unsaturated sites of the base resin causing crosslinking thereof, and wherein said crosslinked toner resin is substantially free of sol.

2. A process in accordance with claim 1 wherein said mixing is a batch melt mixing process.

3. A process in accordance with claim 1 wherein said mixing is a continuous melt mixing process.

4. A process in accordance with claim 1 wherein said reactive base resin is a linear unsaturated resin.

5. A process in accordance with claim 1 wherein said reactive base resin is a linear unsaturated polyester resin optionally present in an amount of from about 90 to about 98 weight percent.

6. A process in accordance with claim 5 wherein said linear unsaturated polyester resin has a number average molecular weight ($M_n$) as measured by gel permeation chromatography (GPC) in the range of from about 1,000 to about 20,000, weight average molecular weight ($M_w$) in the range of from about 2,000 to about 40,000, a molecular weight distribution ($M_w/M_n$) in the range of from about 1.5 to about 6, an onset glass transition temperature (Tg) as measured by differential scanning calorimetry in the range of from about 50° C. to about 70° C., and a melt viscosity as measured with a mechanical spectrometer at 10 radians per second of from about 5,000 to about 200,000 poise at 100° C., said melt viscosity decreasing with increasing temperature to from about 100 to about 5,000 poise at 130° C.

7. A process in accordance with claim 5 wherein said linear unsaturated polyester base resin is prepared from (a) unsaturated diacids or anhydrides selected from the group consisting of maleic acid, fumaric acid, chloromaleic acid, itaconic acid, citraconic acid, mesaconic acid, maleic anhydride, and mixtures thereof; and (b) diols selected from the group consisting of propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and mixtures thereof; and optionally (c) diacids or anhydrides selected from the group consisting of succinic acid, glutaric acid, adipic acid, pimelic acid, suberic acid, azelaic acid, sebacic acid, isophthalic acid, terephthalic acid, hexachloroendomethylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and mixtures thereof; and (d) unsaturated acids selected from the group consisting of methacrylic acid and acrylic acid.

8. A process in accordance with claim 7 wherein said linear unsaturated polyester resin is propoxylated bisphenol A fumarate.

9. A process in accordance with claim 8 wherein said polyester is copoly[fumaric acid, propoxylated bisphenol A], copoly[fumaric acid/adipic acid/terephthalic acid, propoxylated bisphenol A], copoly[fumaric acid/glutaric acid/terephthalic acid, propoxylated bisphenol A], copoly [fumaric acid/azelaic acid/isophthalic acid, propoxylated bisphenol A], copoly[fumaric acid/terephthalic acid, propoxylated bisphenol A/diethylene glycol], copoly[fumaric acid/terephthalic acid, propoxylated bisphenol A/2,2,4-trimethylpentane-1,3-diol], copoly[fumaric acid, tetrabromobisphenol dipropoxy ether], copoly[fumaric acid/sebacic acid, tetrabromobisphenol dipropoxy ether], or copoly [fumaric acid/sebacic acid, tetrabromobisphenol dipropoxy ether/dipropylene glycol].

10. A process in accordance with claim 1 wherein said initiator is t-butyl hydroperoxide, 2,5-dihydroperoxy-2,5-dimethylhexane, cumene hydroperoxide, and t-amyl hydroperoxide, dicumyl peroxide, 2,5-dimethyl-2,5-di(t-butylperoxy)hexane, t-butyl-α-cumyl peroxide, α-α-bis(t-butylperoxy)diisopropyl benzene, di-t-butyl peroxide, t-amyl peroxide, and 2,5-dimethyl-2,5-di(t-butylperoxy) hexyne-3, t-amylperoxyacetate, t-butylperoxybenzoate, t-amylperoxybenzoate, t-butylperoxyacetate, OO-t-butyl-O-(2-ethylhexyl)monoperoxycarbonate, OO-t-amyl-O-(2-ethylhexyl)monoperoxycarbonate, OO-t-butyl-O-isopropylmonoperoxycarbonate, 2,2-di(t-amylperoxy) propane, n-butyl-4,4-bis(t-butylperoxy)valerate, 1,1-di(t-butylperoxy)-3,3,5-trimethylcyclohexane, 1,1-di(t-butyl) peroxycyclohexane, 1,1-di(t-amylperoxy)cyclohexane, 2,2-di(t-butylperoxy)butane, ethyl 3,3-di(t-butylperoxy)butyrate or ethyl 3,3-di(t-amylperoxy)butyrate; and is employed in an amount of from about 0.1 to about 0.5 weight percent of toner comprised of resin, and pigment.

11. A process in accordance with claim 1 wherein said amine polyester is copoly and is selected in an amount such that the total mole percent of amine functionality is between about 0.1 and 10 weight percent.

12. A process in accordance with claim 1 wherein said mixing is melt mixing, and is accomplished in an extruder.

13. A process in accordance with claim 1 wherein said amine polyester is prepared from (a) diacids or anhydrides selected from the group consisting of succinic acid, glutaric acid, adipic acid, pimelic acid, suberic acid, azelaic acid, sebacic acid, isophthalic acid, terephthalic acid, hexachloroendomethylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, maleic acid, fumaric acid, chloromaleic acid, methacrylic acid, acrylic acid, itaconic acid, citraconic acid, mesaconic acid, maleic anhydride, and mixtures thereof; (b) diols selected from the group consisting of propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromobisphenol dipropoxy ether, 1,4-butanediol; or (c) diol amines selected from the group consisting of N-phenyidiethanol amine, 2,6-dimethanol pyridine, and mixtures thereof.

14. A process in accordance with claim 1 wherein said amine polyester is prepared with from 1 to 50 mole percent of a diol amine selected from the group consisting of N-phenyidiethanol amine, and 2,6-dimethanol pyridine.

15. A process in accordance with claim 1 wherein said amine polyester is employed in an amount that the total mole percent of amine functionality is between about 0.1 and 10 percent.

16. A process in accordance with claim 1 wherein from about 90 to about 98 percent by weight of reactive base resin is selected, and from about 2 to about 10 percent by weight of polyester with amine functionality is selected.

17. A process in accordance with claim 16 wherein from about 96 to about 98 percent of base resin, and about 2 to about 4 percent of polyester amine is selected.

18. A reactive melt mixing process for the preparation of a low fix temperature toner resin consisting essentially of:

(a) mixing a reactive base resin, an initiator, and a polyester with amine functionality, wherein said base resin is an unsaturated resin, and (b) crosslinking the resulting polymer melt under high shear to form a crosslinked toner resin, and wherein there occurs a reaction between said initiator and said amine functionality thereby forming free radicals which attack the unsaturated sites of the base resin causing crosslinking thereof, and wherein said crosslinked toner resin is substantially free of sol.

19. A process in accordance with claim 18 wherein said crosslinked toner resin is comprised of crosslinked gel particles and a noncrosslinked or linear portion, and wherein the gel content of said crosslinked resin ranges from about 0.1 to about 40 percent by weight.

20. A process in accordance with claim 18 wherein the gel content is from about 10 to about 19 percent by weight.

* * * * *